US005769035A

United States Patent [19]

Fiedler

[11] Patent Number: 5,769,035

[45] Date of Patent: Jun. 23, 1998

[54] BOILER FURNACE PUFF SOOTBLOWER

[75] Inventor: Ronald G. Fiedler, Fairlawn, Ohio

[73] Assignee: McDermott Technology, Inc., New Orleans, La.

[21] Appl. No.: 736,637

[22] Filed: Oct. 24, 1996

[51] Int. Cl.[6] ..... F22B 37/48; F22B 37/54

[52] U.S. Cl. ..... 122/384; 122/382; 122/379

[58] Field of Search ..... 122/379, 380, 122/381, 384, 390, 391, 392

[56] References Cited

U.S. PATENT DOCUMENTS

| | | | |
|---|---|---|---|
| 808,982 | 1/1906 | Gronvald . | |
| 1,026,141 | 5/1912 | Bayer . | |
| 1,032,495 | 7/1912 | Nutter . | |
| 1,931,272 | 10/1933 | Snow | 122/392 |
| 2,185,450 | 1/1940 | Wager | 285/30 |
| 2,350,929 | 6/1944 | Ridley | 122/391 |
| 3,973,523 | 8/1976 | Keller et al. | 122/510 |
| 4,204,503 | 5/1980 | Reilly et al. | 122/392 |
| 4,456,057 | 6/1984 | Melcer | 165/95 |
| 4,462,795 | 7/1984 | Vosper et al. | 432/29 |
| 4,488,516 | 12/1984 | Bueters et al. | 122/379 |
| 4,667,613 | 5/1987 | Mayock | 122/392 |
| 4,813,384 | 3/1989 | Zalewski | 122/379 |
| 5,092,280 | 3/1992 | Franklin et al. | 122/379 |
| 5,355,844 | 10/1994 | Kendrick | 122/390 |

OTHER PUBLICATIONS

*Steam: its generation and use,* 40th Edition, Copyright ©1992 by The Babcock & Wilcox Company, pp. 25–8, 31–1 to 31–4; and 31–8.

*Steam: its generation and use,* 39th Edition, Copyright ©1978 by The Babcock & Wilcox Company, pp. 25–5 to 25–10 and 27–10.

The Babcock & Wilcox Company "FM Package Boiler" Brochure E101–3103, Copyright©1994.

*Primary Examiner*—Henry A. Bennett
*Assistant Examiner*—Gregory Wilson
*Attorney, Agent, or Firm*—Robert J. Edwards; Eric Marich

[57] ABSTRACT

A sootblower system for a furnace combustion zone has two types of blower pipes. A first type is made of a high temperature resistant material, and projects a short distance vertically through the floor of the furnace into the combustion zone and has blower orifices substantially parallel to the floor. The second type of blower pipe is made of conventional metallurgical materials and the blower outlet is positioned between and extends through adjacent tubes in a membrane wall at a location proximate the furnace floor. Both types of blowers are stationary and continuously remain in position, inserted in the combustion zone. Both types are small in size and large in number and only a small number of blowers are active at any time. In operation, discrete puffs of blowing medium are forced through the blower pipes and across the furnace floor, entraining ash and particulates into the combustion gas stream, preventing small amounts of ash buildup within the furnace.

6 Claims, 6 Drawing Sheets

FIG.4
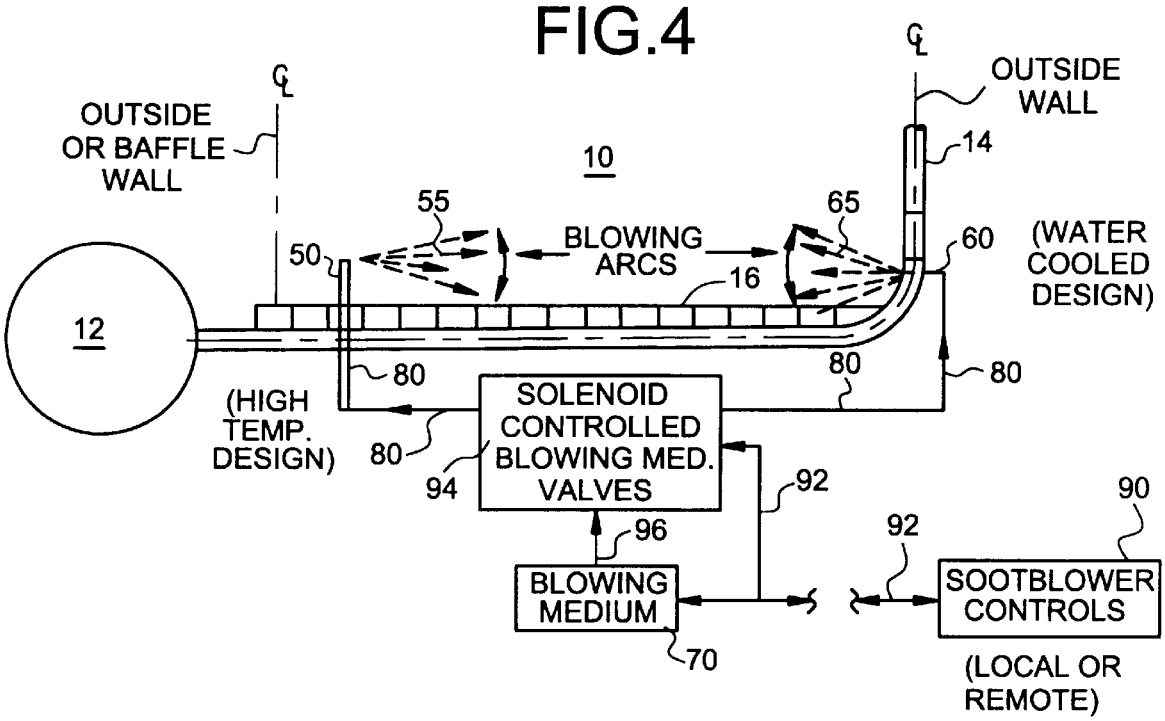
FIG.5
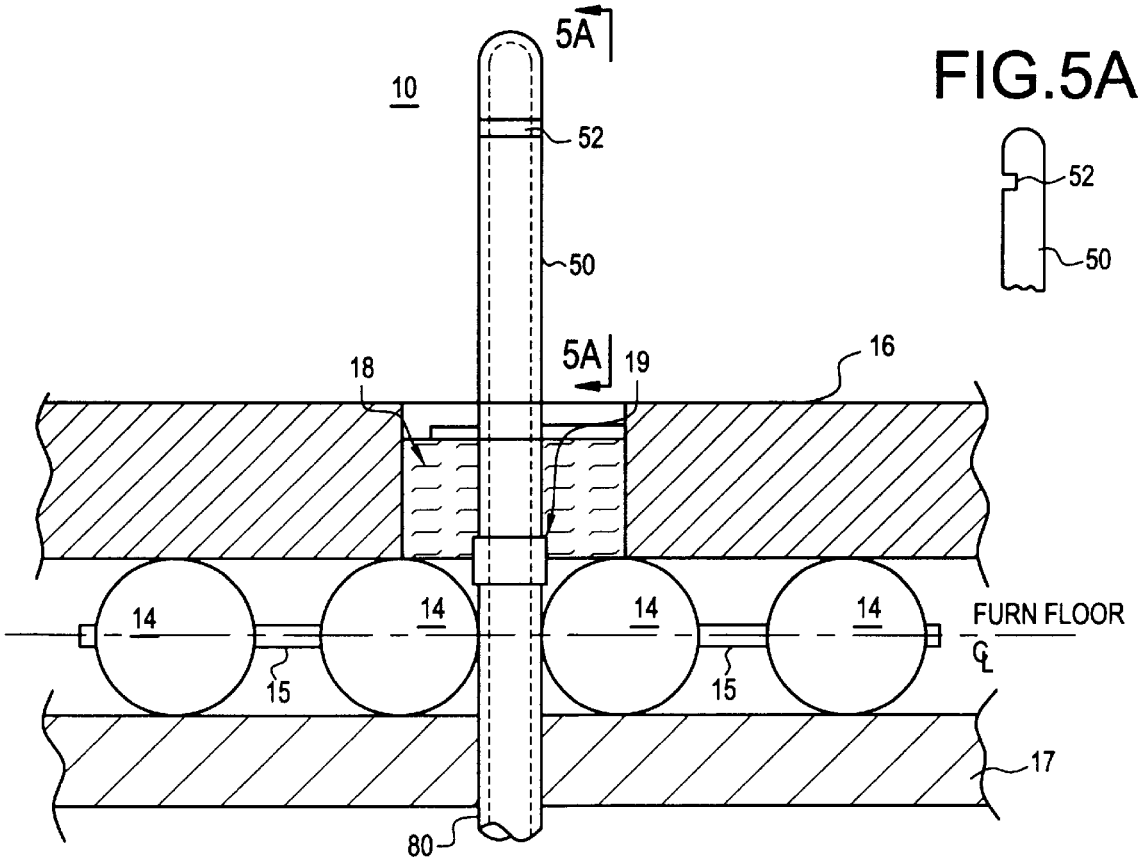
FIG.5A

BOILER FURNACE PUFF SOOTBLOWER

FIELD AND BACKGROUND OF THE INVENTION

The present invention relates generally to the field of ash removal from solid fuel burning boilers, combustors, steam generators and furnaces, and in particular, to a new sootblower arrangement and system for removing ash from the combustion zone of a flat floor, solid fuel fired boiler, combustor, steam generator or furnace.

As used herein in the present specification, the term "flat floor" refers to a furnace floor surface with a generally flat or planar configuration which is horizontal or substantially horizontal. In functional terms, the term "flat floor" means that, even if the furnace floor is provided with a slight slope or inclination from the horizontal, the slope is normally insufficient to cause ash or solids particles landing thereon to slide down there across by the force of gravity for removal. In practical terms, the term "flat floor" thus includes furnace floors which are generally planar, regardless of construction materials, and are usually inclined at angles up to and including approximately 5 to 7 degrees from the horizontal. In any event, such flat floors are to be distinguished from hopper bottom type furnace constructions whose walls are sloped at much greater angles of inclination from the horizontal (e.g., 45 to 50 degrees, etc.) and which are intended to and which do cause removal of ash and solids particles therefrom by the force of gravity.

The term "package boilers" refers to boilers which are designed for factory assembly. See for example, U.S. Pat. Nos. 4,462,795 and 3,173,523. A particularly successful package boiler design is known as the FM Package Boiler manufactured by The Babcock & Wilcox Company and disclosed in the publication *Steam: its generation and use*, 40th Edition, page 25-8. Other types of flat floor package boilers include what are known as "F" type boilers, particularly the PFI (Power for Industry) and PFT (Power for Turbine) described in *Steam: its generation and use*, 39th Edition, Chapter 25, pages 25-8 and 25-9. Also known are the "Three Drum Waste Heat Boilers" shown on page 27-10, FIG. 10, of *Steam: its generation and use*, 39th Edition and on page 31-8 of *Steam: its generation and use*, 40th Edition. This latter type of boiler is also known as an "FO" type, and in the industry as simply an "O" type boiler. All of these boiler types are typically provided with the flat floor construction described above, since they were not originally designed to fire solid fuels or fuels which produced substantial amounts of ash or solids particles. For a better understanding of the term FM Package Boiler, the reader is referred to The Babcock & Wilcox Company brochure entitled "FM Package Boilers", number E101-3103 10M H 1/94, 12 pages, Copyright 1994, the text of which is hereby incorporated by reference as though fully set forth herein.

As indicated above, conventional boilers, combustors, steam generators, and/or furnaces that fire solid fuels either have hopper bottoms so that the ash can exit from the bottom of the unit or stokers to convey the ash to a hopper or ash disposal system out of the combustion zone.

FIGS. 1, 2 and 3 are perspective, right end axial and longitudinal schematic illustrations of the aforementioned FM package boiler. These Figs. illustrate basic features common to such package boilers and will thus only be briefly discussed. As shown in FIG. 1, furnace wall water cooling I is provided in sidewalls, roof and floor and also in the high duty rear wall to minimize refractory and maintenance thereof. A gas-type setting membrane 2 minimizes gas leaks. The entire boiler rests on a steel base frame 3, and lagging 4 encloses the structures. An upper steam drum within internals 5 provides high purity steam and a source for natural circulation fluids. Water wash troughs and drain 6 are also provided, as are grooved tube seats 7. For cleaning of the convection bank tubes, sootblowers 8 are located as shown. Finally front wall fire brick 9 is provided at the front wall and allows for expansion and protection of front corner seals.

FIGS. 2 and 3 illustrate general orientation and other features of such FM package boilers. Element A refers to the furnace side wall, while B refers to the boiler side wall. Both are typically membraned tubes provided with exterior steel or aluminum lagging. Elements C and D refers to the boiler rear wall and front wall, respectively. While the rear wall is typically water cooled, the front wall is constructed of refractory as discussed earlier in connection with FIG. 1. The membrane floor E is also water cooled, but is provided with an upper layer of refractory brick, while the roof F is also of membraned construction provided with exterior lagging.

Sootblowers are used to remove solid material (ash) from refractory, and metal, usually tube or membrane internal surfaces solid fuel fired boilers, combustors, steam generators, and/or furnaces. Sootblowers are generally located out of the combustion zone of the furnace. This material must be removed to prevent the unit from having to be shut done for cleaning. The build up of this material, ash, also adversely affects the heat transfer performance, efficiency, of the units increasing the fuel consumption and operating expenses.

Conventional sootblowers used in solid fuel fired boilers/furnaces fall into two major categories or types The first type of sootblower is utilized in what is referred to as a high temperature zone. The temperature in these zones are beyond what the metallurgy of conventional pressure part ASME (American Society of Mechanical Engineers) Code steel alloy materials can withstand, usually above 2000° F., and in some cases above 3000° F. Therefore, this first type of sootblower is designed to be retractable from the high temperature zone and is also cooled by the blowing medium, usually air or steam passing through the blowing element itself, during operation. This permits the use of normal ASME Code materials.

This type of sootblower is intended primarily to clean large amounts of ash or slag from furnace components, and therefore must deliver large blasts of air or steam to dislodge the waste material.

The second type of type sootblower is utilized in a lower temperature zone that conventional ASME Code metallurgy materials can be designed to withstand. The temperature in this zone is usually less than 1500° F., and at this lower temperature, this type of sootblower remains inserted in the furnace or steam generator at all times. They are only activated when needed to dislodge ash or waste material.

Another type of sootblower is known and was used about 50 years ago, on pinhole grate (usually coal) stokers. These sootblowers were small nozzles that penetrated the air cooled surface of the stoker grate. Since the grate was air cooled, these sootblowers were subjected to much less heat and did not have to overcome the high, 2000° F. temperatures described above.

U.S. Pat. No. 4,813,384 discloses a retractable sootblower lance having a ceramic coating. The coating is for providing additional protection to the sootblower from the high temperatures produced by a furnace.

U.S. Pat. No. 4,456,057 discloses a sootblower system for a heat exchanger. These sootblowers consist of a double-pipe having outlets between the inner and outer pipes for delivering a soot blowing medium from the inner pipe to the heat exchanger surfaces. A gap is provided between the inner and outer pipes. These sootblowers are intended only for use in the wall-cooled environment of a heat exchanger, and not for use in a furnace.

U.S. Pat. No. 5,355,844 discloses a system for removing slag from a furnace by directing a jet of cooler, pressurized air through the floor drain of a furnace to cause slag and other wastes to fall off of furnace components and into a slag hopper below the drain. The nozzle providing the air does not extend into the furnace region, and is for providing distinct, highly pressurized blasts of air to the furnace lower regions.

Flat floor, solid fuel fired boilers or furnaces, however, present additional problems with respect to ash removal, particularly if there is ash accumulation in the combustion zone. With a flat floor and no stoker or hopper to remove the ash, there is no place for the ash to go if some drops from the gas stream onto the furnace floor. This ash thus typically cannot be removed during furnace operation.

Using known sootblowers, in the combustion zone, presents a problem, however, in that occasionally large amounts of combustible material is contained within the ash. If it is loosened and swirled within the combustion zone, an explosive fuel source for the furnace is created.

SUMMARY OF THE INVENTION

It is therefore an object of the present invention to overcome these problems and provide a sootblower arrangement and system which can be used effectively in several different types of combustion zones of flat floor furnaces burning solid fuels.. As used herein in the present specification, examples of such solid fuels to which the present invention is applicable include coal, coke, sawdust, wood, wood chips, etc.

Accordingly, one aspect of the present invention is drawn to a sootblower system for entraining and removing ash from the combustion zone of a flat floor, solid fuel fired boiler, and which uses two types of sootblowers. Each of the two types of sootblowers has a source end for receiving a blowing medium and a blower end for discharging the blowing medium therefrom.

The first type of sootblower which is used with this system is mounted on a side membrane wall of the furnace adjacent the floor, between tubes in the membrane wall. The blowers are sufficiently short that the materials used for the blowers are cooled by the water in the adjacent tubes. Preferably, the blowers are welded to the tube walls, and may be made from standard ASME materials.

The second type of blower is located in the floor of the furnace. These blowers project vertically a distance into the furnace and have blower orifices oriented obliquely or parallel to the furnace floor. These blowers must be capable of withstanding much higher temperatures; however, the materials used do not have to withstand higher pressure standards, as the blowers are open-ended and almost completely within the furnace region, i.e., they would be defined by the ASME Code as being "within the setting". Space age metal alloys, ceramics or other materials capable of withstanding temperatures over 2000° F. must be used for these blowers.

The sootblower arrangement and system according to the present invention, using these two types of small, individual blowers that are used in sequence and not concurrently, improves the safety of the furnace, since large amounts of combustible material are not suddenly being injected into the combustion gas flow, as would be the case with conventional larger sootblowers. Thus, the sootblowers of the present invention are operated or "puffed", not so much to remove adhered ash deposits from the flat floor, but rather to reentrain ash which has been deposited thereon. The sootblowers would be accordingly operated for shorter periods of time and with only enough blowing media to accomplish that purpose. Also, since the sootblowers are stationary, they are mechanically less complex than conventional sootblowers, and therefore easier to maintain.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

BRIEF DESCRIPTION OF THE DRAWINGS

In the drawings:

FIG. 4 is a partial sectional side elevation of a portion of a flat floor furnace showing the sootblower system of the invention;

FIG. 5 is a partial sectional front elevation of one sootblower of the system shown in FIG. 4;

FIG. 5A is a partial sectional view of one floor sootblower of the type shown in FIG. 5, taken in the direction of arrows 5A—5A;

DETAILED DESCRIPTION OF THE PREFERRED EMBODIMENT

Figure 1:
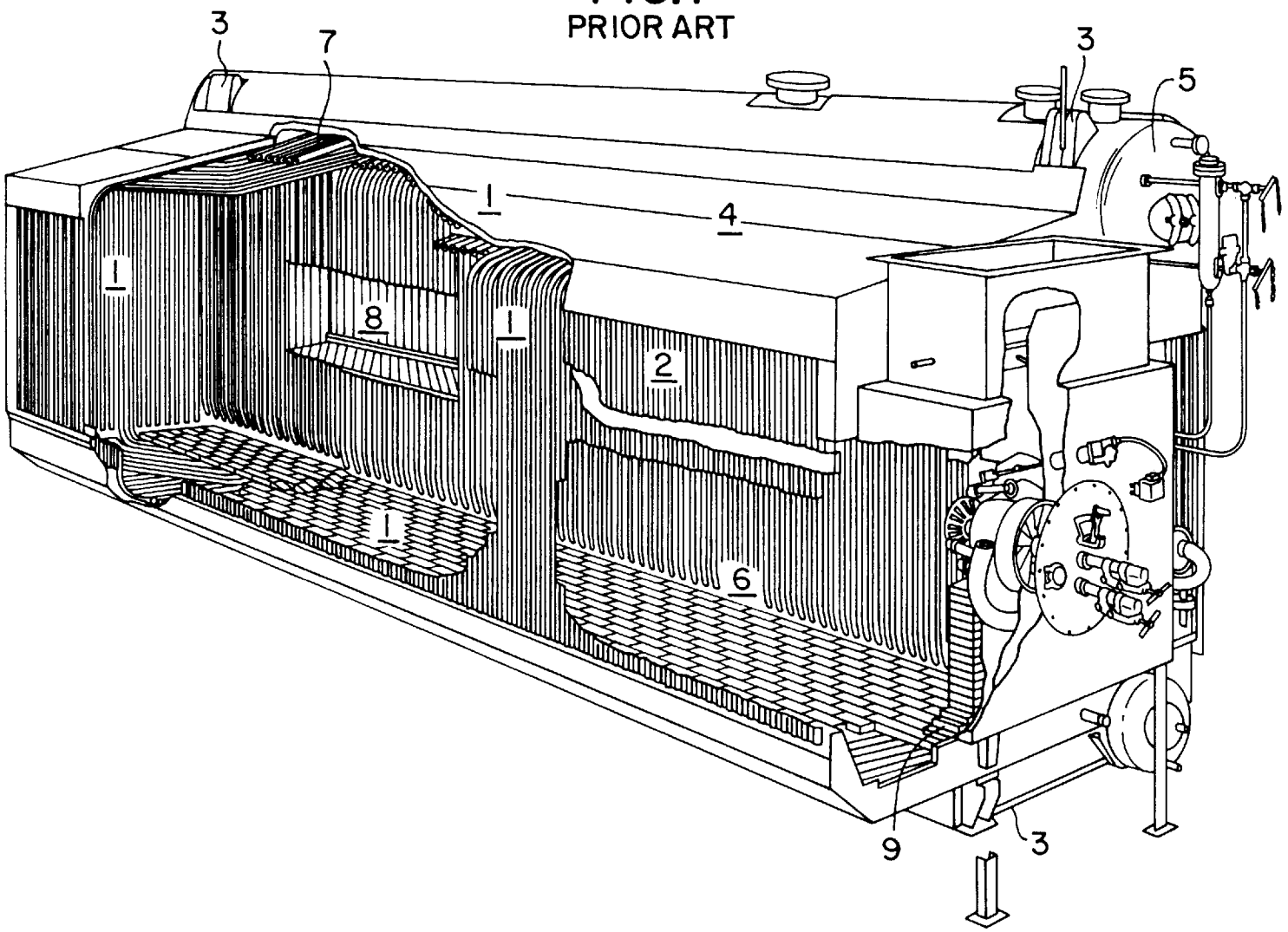
FIG. 1 PRIOR ART
FIG. 1 is a perspective view, partly in section of an FM package boiler to which the present invention is applicable.
Figure 3:
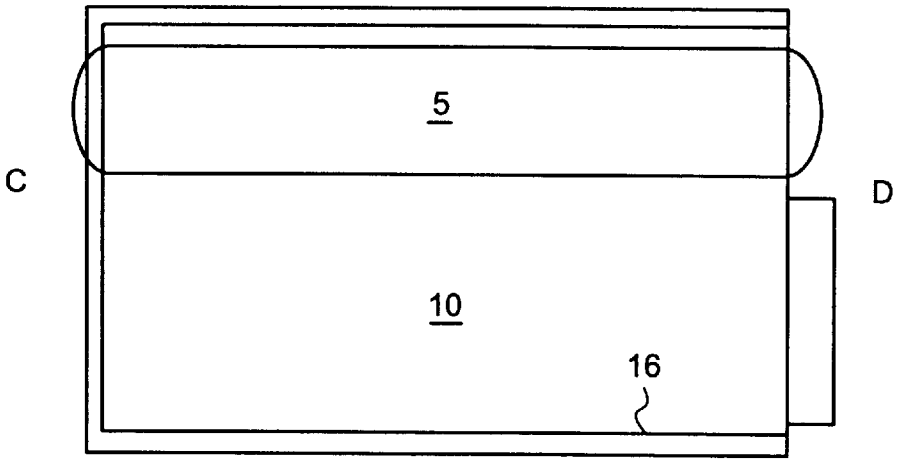
FIG.3 PRIOR ART
FIGS. 2 & 3 are right end axial and longitudinal sections, respectively, of the FM package boiler of FIG. 1.
Figure 2:
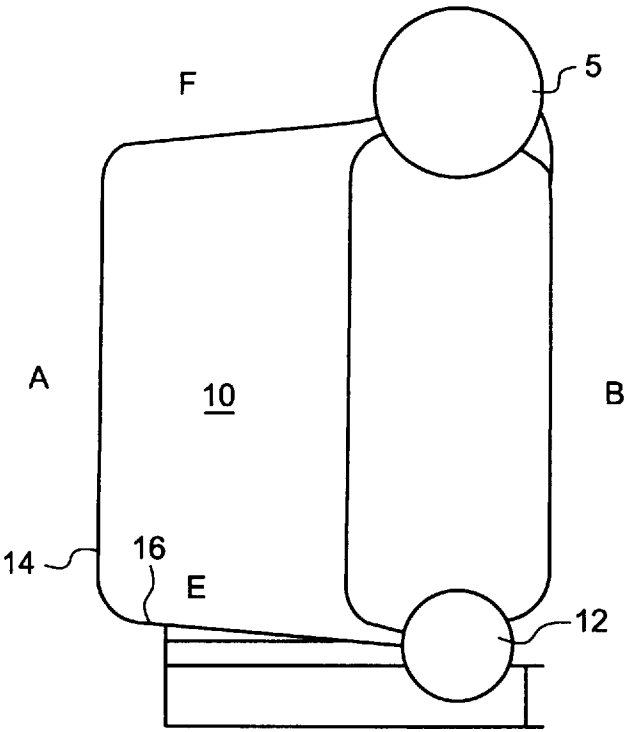
FIG.2 PRIOR ART

Referring now to the drawings, in which the same or functionally similar parts are identified with like reference numerals, FIG. 4 shows a portion of the system of the invention applied in a furnace combustion zone 10, which is one potential environment for the invention. In the combustion zone 10, flat furnace floor 16 lies over water tubes 14 and is flat as described and defined above.

Water tubes 14 extend underneath floor 16 and curve upward at one edge of floor 16 to form a side wall of the combustion zone 10. Adjacent tubes 14 are connected to each other by membrane bars 15 (shown in FIG. 5) to make the tube wall continuous. The water tubes 14 are connected to a lower water tube header or steam drum 12, which supplies relatively cool water to the tubes 14.

The system has two types of sootblower pipes 50, 60 positioned to provide a blowing medium from a blowing medium source 70, to a location near the furnace floor 16, as indicated by arrows 55, 65. Each of the two types of blower pipes 50, 60 is shown in greater detail in FIGS. 5, 5A and 6. Although only a single blower 50, 60 of each type is shown in the drawings, a plurality of each blower 50, 60 is used in the system of the invention to prevent ash buildup in the combustion zone 10.

A first type of blower used with the system is shown in FIG. 5, wherein high temperature blower pipe 50 extends vertically through an insulation filled gap 18 in furnace floor 16 into the combustion zone 10. The blower pipe 50 is positioned between adjacent water tubes 14 beneath furnace floor 16, as well as through insulation 17. The blower pipe 50 may be inserted through an opening in, and welded to, membrane bar 15 which connects adjacent tubes 14. An adaptor sleeve 19 connects each individual blower pipe 50 to associated blower medium piping 80.

Blower 50 is an elongated pipe, and may be of unitary or segmented construction. Blower orifice 52 is located at the furnace end of blower pipe 50, and is oriented approximately parallel to furnace floor 16. As shown in FIG. 5A, it typically comprises a short, preferably ⅛" high, simple cut placed into a wall of the blower pipe 50 from the side. During sootblower 50 operation, the blowing medium is emitted from orifice 52 over floor 16 in an arc as indicated by arrows 55 in the Figs., and thereby entrains particulate matter and ash lying on the furnace floor 16 into the furnace gases flowing through the furnace combustion zone 10.

Figure 7:
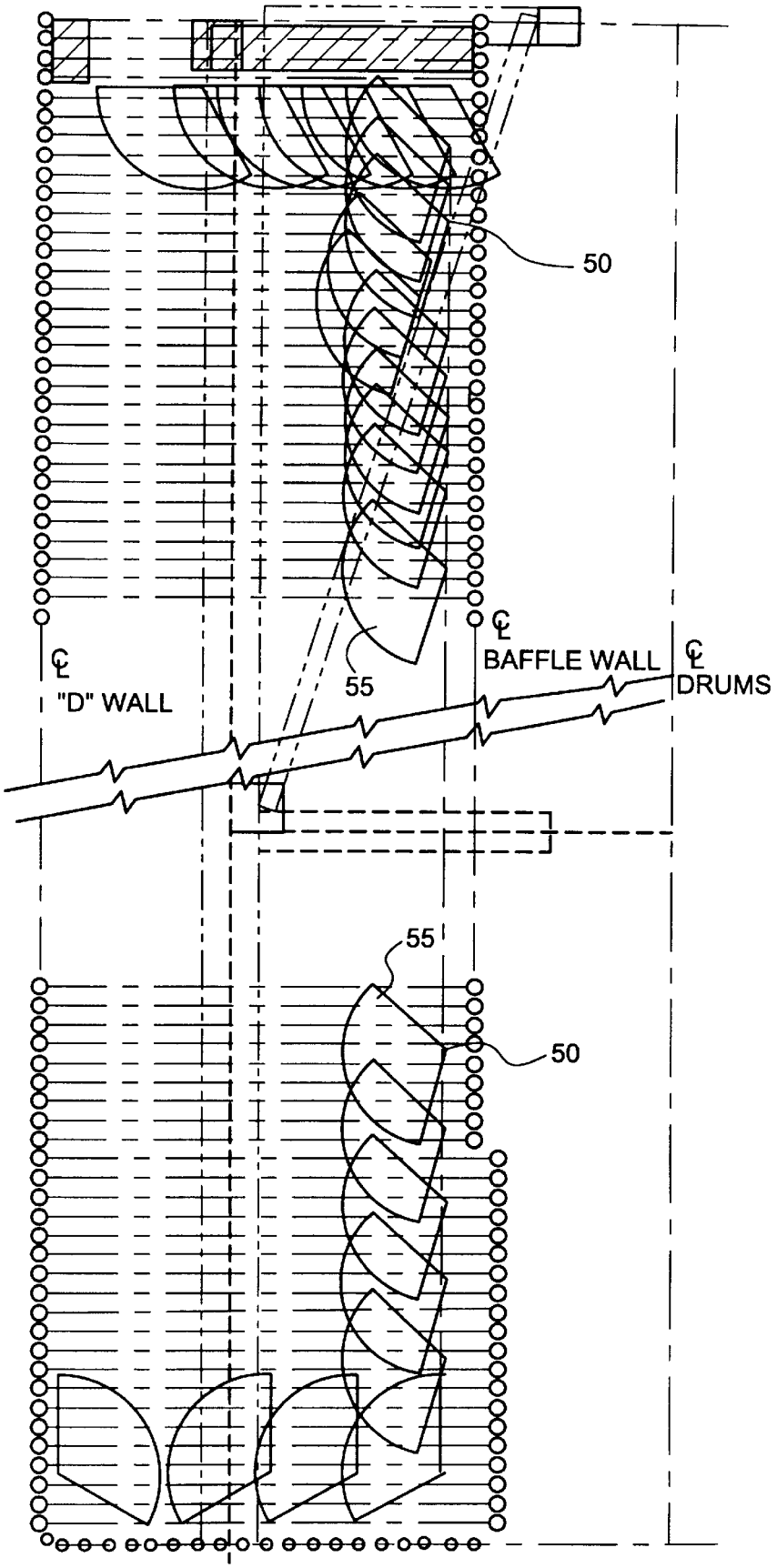
FIG. 7 is a plan elevation of the combustion zone of a flat floor furnace illustrating typical floor nozzle locations and their respective blowing arcs.

In the system of the invention, several blowers 50 are positioned at various points around the floor 16 in the combustion zone 10. The blowing medium is provided in short bursts at regular intervals to desired floor blowers 50, and it then exits through the orifices 52 in each blower 50 to continuously mix and agitate the ash off of the flat floor 16 into the flowing furnace gases. Typical locations of such blowers 50 and their respective cleaning arcs is shown in FIG. 7. According to a particular emphasis of the present invention, the arrangement of a plurality of small capacity, individual sootblowers as disclosed permits a method of operation in which not all of the blowers 50 or 60 operate at the same time. This minimizes the amount of ash and potentially combustible material being reentrained into the furnace gases at any given time, and thus reduces the explosion potential of such reentrainment while still cleaning the furnace combustion zone 10.

The blower pipe 50 is stationary; i.e., it is not retracted from the combustion zone 10, and therefore must be manufactured from materials which can withstand temperatures exceeding 2000° F. (1093° C.). However, since the blower is open-ended, at orifice 52, and completely contained within the furnace setting, it need not meet ASME Code pressure part specifications. Acceptable materials for the blower pipe 50 include space age metal alloys, ceramics, or other known heat resistant materials.

Figure 6:
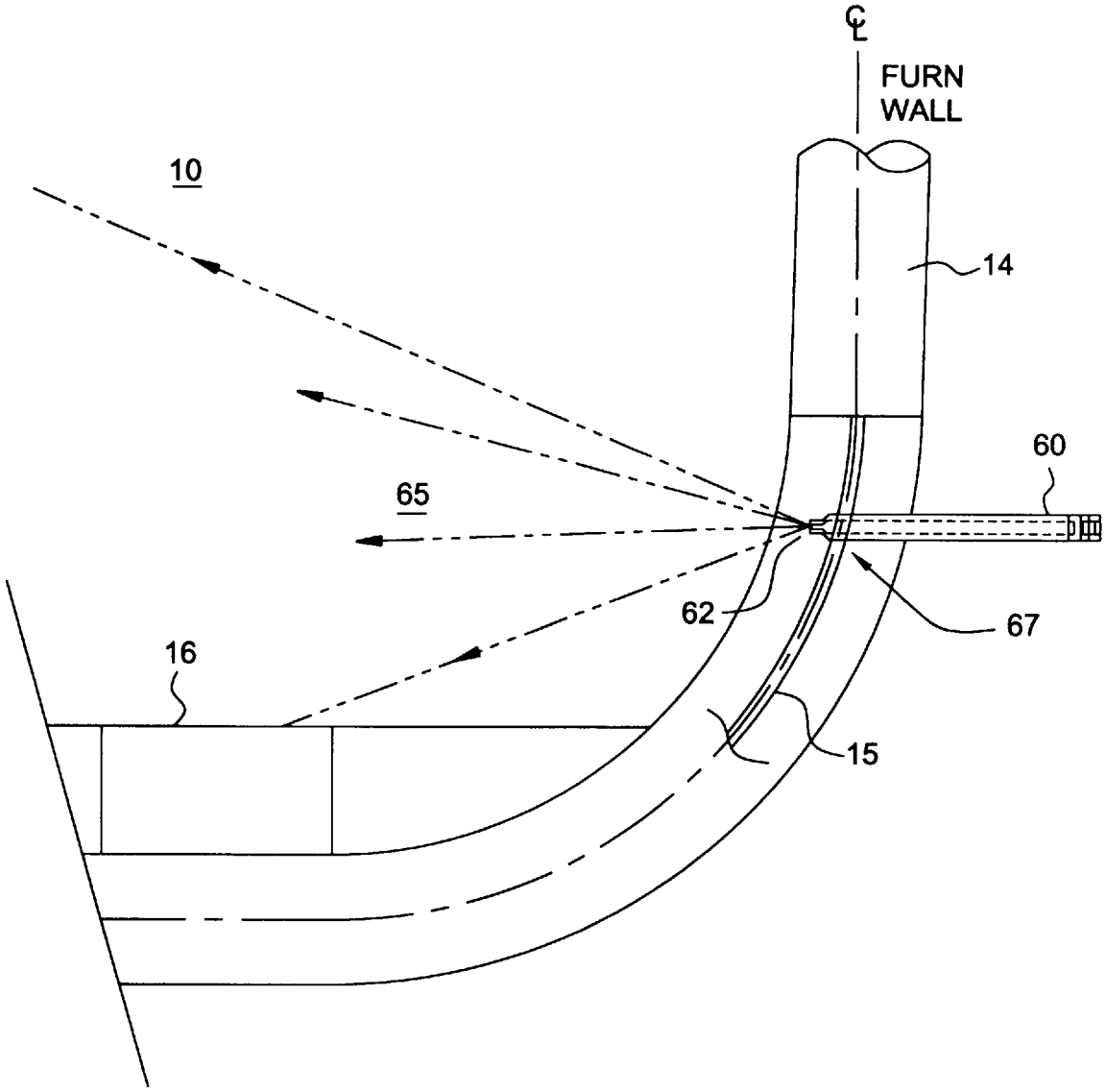
FIG. 6 is a detail sectional side elevation of a second sootblower of the system shown in FIG. 4.

The second type of blower is the wall-cooled blower pipe 60, shown in greater detail in FIG. 6, which shows a sectional detail of the orientation of wall-cooled blower pipe 60. The wall-cooled blower 60 is substantially parallel to the furnace floor 16 and located proximate the floor 16. The wall-cooled blower 60 is positioned such that its nozzle opening 62 is located between adjacent water tubes 14, extending just into the combustion zone 10, still in communication with the combustion zone 10. Again, nozzle opening 62 is simple in construction, preferably made by merely heating and crimping the end of pipe 60 to produce an approximately 0.1" high slot.

Figure 8:
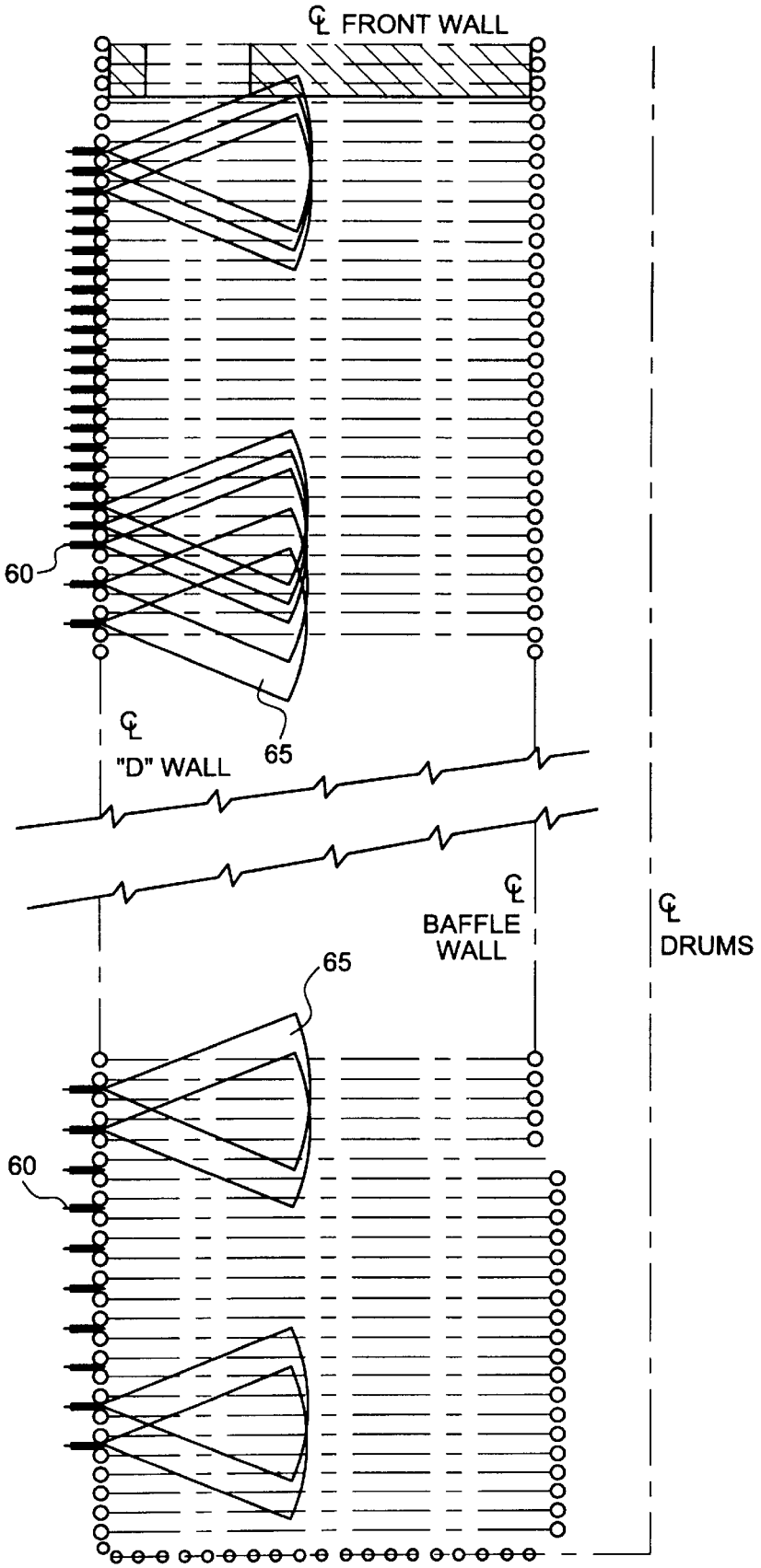
FIG. 8 is a plan elevation of the combustion zone of a flat floor furnace illustrating typical wall nozzle locations and their respective blowing arcs.

The positioning of the blower pipes 60 allows the water-cooled wall of water tubes 14 to maintain the temperature of the wall-cooled blower 60 at an appropriate temperature level during operation of the furnace which permits the use of ASME standard materials for the construction of the blower pipe 60. Typical locations of such water-cooled blowers 60 and their respective cleaning arcs is shown in FIG. 8.

The blower pipes 60 may be welded to water tubes 14 and/or membrane bars 15 once the blower pipes 60 are positioned, as illustrated at 67 in FIG. 6. As with blowers 50, although only one wall-cooled blower pipe 60 is shown, a plurality of blower pipes 60 are used with the system.

To complete the sootblower system of the present invention, there would of course be provided a blowing medium source 70 under the control of local or remote sootblower controls 90. The sootblower controls 90 control application of the blowing medium 70 to the individual sootblowers 50, 60 via line 92. Line 92 is also advantageously connected to an arrangement of solenoid controlled blowing medium valves and interconnecting piping, generally designated 94 in FIG. 4. The blowing medium 70 is provided to this arrangement of solenoid controlled blowing medium valves 94 via line 96 and thence to blower medium piping 80 as shown in FIG. 4. As will be readily appreciated by those skilled in the sootblowing arts, various configurations and interconnections of the sootblowers 50, 60 and the solenoid controlled blowing medium valves 94 may be provided. The number and types of sootblowers 50 and 60 connected together in a group, as well as the number of sootblowers controlled by a single solenoid blowing medium valves 94, will be selected to achieve a desired degree of control over the system as required. For example, it may be desired to operate some of the plurality of sootblowers 50 and/or 60 in a given area of the combustion zone 10 prior to operation of later, downstream locations of sootblowers 50, 60. Proper sequencing and puffing of the sootblowers 50 and/or 60 from front to back of the furnace combustion zone 10 would then reentrain the ash into the flue gas at the front wall or inlet to the furnace, maintain it suspended in the flowing flue gases as they pass through the combustion zone, and keep the ash entrained so that it can be carried out of the unit to external particulate collection equipment of known design. The sootblower controls 90 would then be programmed and operated so that the associated interconnecting piping and solenoid valves 94 achieve such a method of operation.

While a specific embodiment of the invention has been shown and described in detail to illustrate the application of the principles of the invention, it will be understood that the invention may be embodied otherwise without departing from such principles.

I claim:

1. A sootblower system for entraining and removing ash from the combustion zone of a flat floor, solid fuel fired boiler, comprising:

a combustion zone defined by a furnace floor and a plurality of furnace walls, each furnace wall connected to the furnace floor and to two adjacent furnace walls, wherein at least one furnace wall is a water-cooled wall comprising a plurality of adjacent water tubes;

a plurality of first stationary sootblower pipes projecting substantially vertically through the furnace floor into the combustion zone, each of said first stationary sootblower pipes having a blower end and a source end, the blower end being provided with an opening oriented substantially parallel to the furnace floor and in communication with the combustion zone;

a plurality of second stationary sootblower pipes, each of said second stationary sootblower pipes having a blower end and a source end, each blower end extending between adjacent water tubes in the water-cooled wall into the combustion zone at a location proximate the furnace floor and in communication with the combustion zone; and blower medium means for providing a blowing medium to each of the plurality of first stationary sootblower pipes and the plurality of second stationary sootblower pipes connected to each source end of the first sootblower pipes and to each source end of the second sootblower pipes.

2. The sootblower system according to claim 1, wherein the blower medium means further comprises sootblower control means for providing the blowing medium in discrete bursts to specific ones of the sootblower pipes, such that when the blowing medium is puffed through any of the pluralities of first and second sootblower pipes, a small amount of ash on the furnace floor is entrained in a gas stream within the combustion zone.

3. The sootblower system according to claim 2, wherein each of the first plurality of stationary sootblower pipes is made of one of ceramic and high-temperature resistant metal alloys.

4. The sootblower system according to claim 3, wherein each of the second plurality of stationary sootblower pipes is made of steel alloys.

5. The sootblower system according to claim 1, wherein each of the first plurality of stationary sootblower pipes is made of one of ceramic and high-temperature resistant metal alloys.

6. The sootblower system according to claim 1, wherein each of the second plurality of stationary sootblower pipes is made of steel alloys.

* * * * *